US006764409B1

(12) United States Patent
Voden

(10) Patent No.: US 6,764,409 B1
(45) Date of Patent: Jul. 20, 2004

(54) ROTARY POOL AND AIR POWERED HOCKEY GAME TABLE

(76) Inventor: Justin L. Voden, S84 W19093 Enterprise Dr., Muskego, WI (US) 53150

( * ) Notice: Subject to any disclaimer, the term of this patent is extended or adjusted under 35 U.S.C. 154(b) by 0 days.

(21) Appl. No.: 10/337,623

(22) Filed: Jan. 7, 2003

(51) Int. Cl.[7] ..... A63D 15/00; A63D 15/04; A47C 17/62; A63F 9/00

(52) U.S. Cl. ..... 473/10; 473/14; 473/15; 473/4; 273/309; 273/126 A

(58) Field of Search ..... 473/1, 4, 10, 14, 473/15, 19; 158/28, 128, 6, 1, 11, 19, 12, 94; 273/309, 126 A; D21/318, 385, 397

(56) References Cited

U.S. PATENT DOCUMENTS

| | | | | | |
|---|---|---|---|---|---|
| 122,830 | A | * | 1/1872 | Heyl | 473/14 |
| 211,083 | A | * | 1/1879 | Bensinger | 473/10 |
| 747,726 | A | * | 12/1903 | Karhan | 473/9 |
| D247,127 | S | * | 1/1978 | Kavka | D21/318 |
| 4,305,581 | A | | 12/1981 | Neuharth | 273/5 R |
| 4,927,140 | A | * | 5/1990 | Pappas | 473/8 |
| 6,109,607 | A | * | 8/2000 | Cartwright et al. | 273/108.1 |
| 6,155,564 | A | | 12/2000 | Tsai | 273/108.1 |
| 6,347,797 | B1 | | 2/2002 | Tsai | 273/309 |

* cited by examiner

*Primary Examiner*—Stephen P. Garbe
*Assistant Examiner*—Mitra Aryanpour
(74) *Attorney, Agent, or Firm*—Donald J. Ersler

(57) ABSTRACT

A rotary pool and air powered hockey game table includes a combination game table, two side support members, and at least one cross member. The combination game table includes a pool table surface formed on one side of the combination table and an air powered hockey table surface formed on the opposite side. The at least one cross member is terminated on each end by a single side support member. The combination game table is pivotally retained by a side support member on each end thereof. At least one locking pin device is disposed in at least one side support member to rotatably secure the game table relative to the side support members. A second embodiment includes at least two pivotal support arms, which prevent the combination game table from rotating. A third embodiment includes at least one side support member configured to retain a plurality of game accessories.

10 Claims, 9 Drawing Sheets

ROTARY POOL AND AIR POWERED HOCKEY GAME TABLE

BACKGROUND OF THE INVENTION

1. Field of the Invention

The present invention relates generally to game tables and more specifically to a rotary pool and air powered hockey game table, which provides either a full size pool table or an air powered hockey table by rotation of a combination game table.

2. Discussion of the Prior Art

It appears that the prior art does not disclose a combination full size pool table and air powered hockey table in one rotatable structure. U.S. Pat. No. 4,305,581 to Neuharth discloses a pivotable playing table. A billiard table is pivotally supported by two pedestals in either a horizontal or vertical position. U.S. Pat. No. 6,155,564 to Tsai discloses an air system structure of rotary game table. A double sided game surface is pivotally retained in a game table base. The double sided game surface includes table soccer on one surface and an air powered hockey table on the opposite surface. U.S. Pat. No. 6,347,797 discloses a game table with using modes convertible by way of rotation. A table body is pivotally retained in a table frame. The table body includes table soccer on one surface and a pool table on the opposite surface.

Accordingly, there is a clearly felt need in the art for a rotary pool and air powered hockey game table, which provides either a full size pool table or an air powered hockey table by rotation of a combination game table and manipulation of index pins or pivotal support arms.

SUMMARY OF THE INVENTION

The present invention provides a rotary pool and air powered hockey game table with a combination game table that is rotated to provide either a full size pool table or an air powered hockey table. A rotary pool and air powered hockey game table (rotary game table) includes a combination game table two side support members and at least one cross member. The combination game table includes a full size pool table surface formed on one side of the combination game table and an air powered hockey table surface formed on the opposite side. The size of the pool table surface is the same as a regulation size pool table. A plurality of pool ball pockets are formed in the pool table surface that are sized to receive normal sized pool balls. A net is preferably used to capture a billiard ball that falls into one of the pool ball pockets. However, other devices may be used to capture a billiard ball that falls into a pool ball pocket, such as a plastic molded pocket.

The air powered hockey table surface includes a plurality of air holes formed through the table surface. A diffuser plate is disposed below the air powered hockey table surface. An air blower is preferably retained in a sliding drawer between the pool table surface and the diffuser plate. An air hole is formed through the diffuser plate to receive an output of the air blower. The air blower draws air from inside the combination game table and pushes the air through the plurality of air holes. A puck slot is disposed on each end of the air powered hockey table to provide scoring in a game of air powered hockey.

Preferably, at least one accessory retainer is terminated on each end with a single side support member. The at least one cross member is also terminated on each end by a single side support member. The combination game table is pivotally retained by a side support member on each end thereof. At least one locking pin device is disposed in each side support member. Each locking pin device is preferably spring loaded such that a spring..pin is in a normally extended position. At least one pin cavity is formed in each end of the combination game table to receive the at least one: locking pin. The at least one locking pin is withdrawn from the at least one pin cavity to allow the game table to be rotated. A separate locking pin may also be used that is withdrawn from each side support member.

A second embodiment of a rotary game table includes a combination game table, two side support members, at least two pivotal support arms and at least one cross member. The combination game table is the same as in the first embodiment. Preferably, at least one accessory retainer acts as the at least one cross member. The at least one accessory retainer is terminated on each end with a single side support member. The combination game table is pivotally retained by one side support member on each end thereof. Each pivotal support arm is pivotally attached to one end of one side support member. The pivotal support arms are swung such that they are parallel with the side support members when rotating the combination game table. Each pivotal support arm is attachable to a single accessory retainer with any suitable quick release fastener. The at least one locking pin device may also be disposed in each side support member.

A third embodiment of a rotary game table includes a combination game table, two side support members, and at least one cross member. The combination game table is the same as in the first embodiment. The at least one cross member is terminated on each end with a single side support member. The combination game table is pivotally retained by one side support member on each end thereof. At least one locking pin device is disposed in each side support member.

A pivotal support arm may be substituted for the at least one locking pin device. Each pivotal support arm would be pivotally attached to one end of one side support member. The A pivotal support arms are swung such that they are parallel with the side support members when rotating the combination game table. Each pivotal support arm is attachable to a single cross member with any suitable quick release fastener.

At least one of the two side support members is preferably configured to retain game accessories such as a plurality of billiard balls, cue sticks, a rack, a puck, and two hockey paddles. A plurality of game accessories is defined by at least two billiard balls.

Accordingly, it is an object of the present invention to provide a rotary game table, which provides the choice of playing billiards or air powered hockey in a single space by the rotation of a combination game table.

These and additional objects, advantages, features and benefits of the present invention will become apparent from the following specification.

DETAILED DESCRIPTION OF THE PREFERRED EMBODIMENTS

Figure 1:
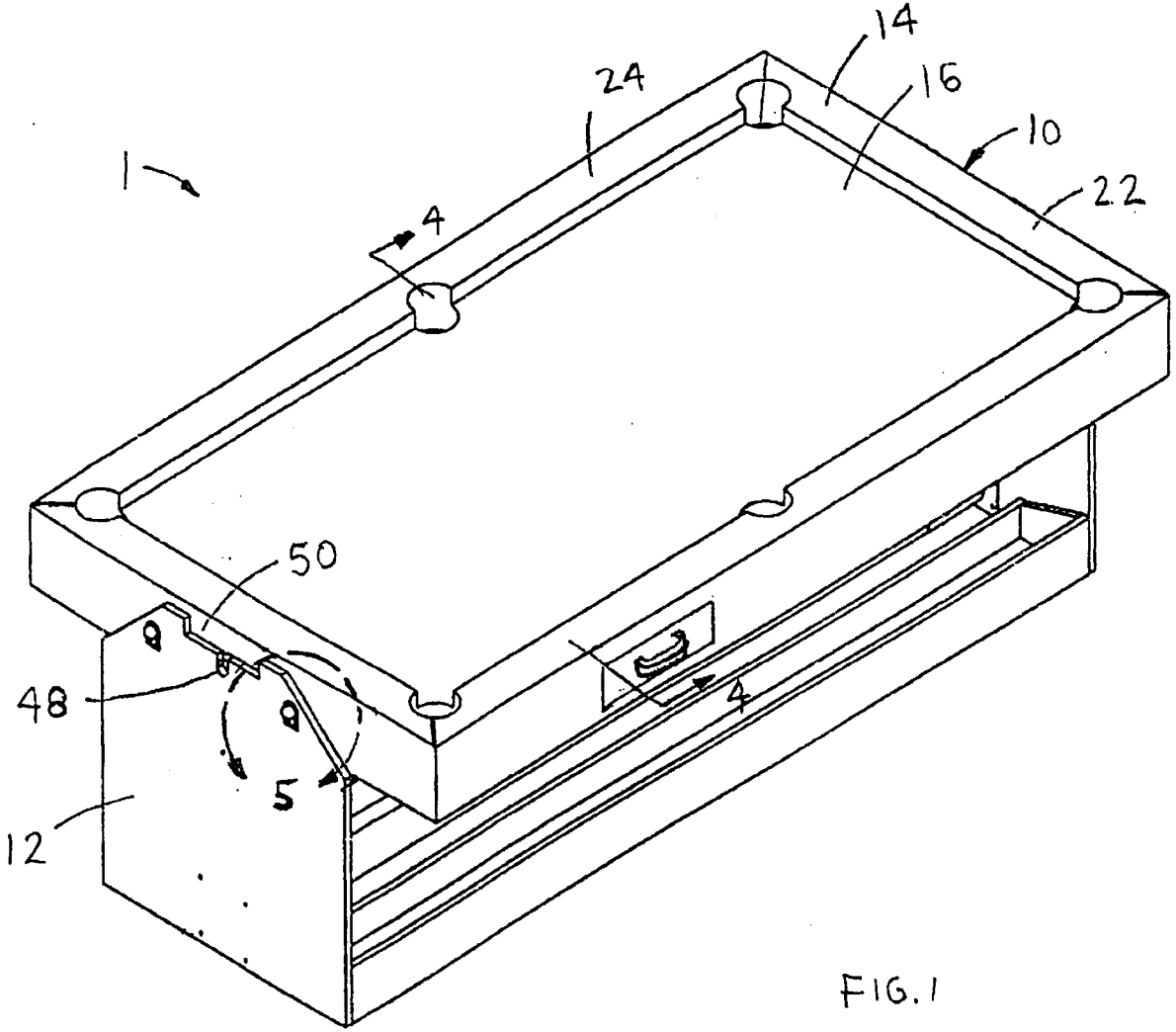
FIG. 1 is a perspective view of a rotary game table in accordance with the present invention.
Figure 2:
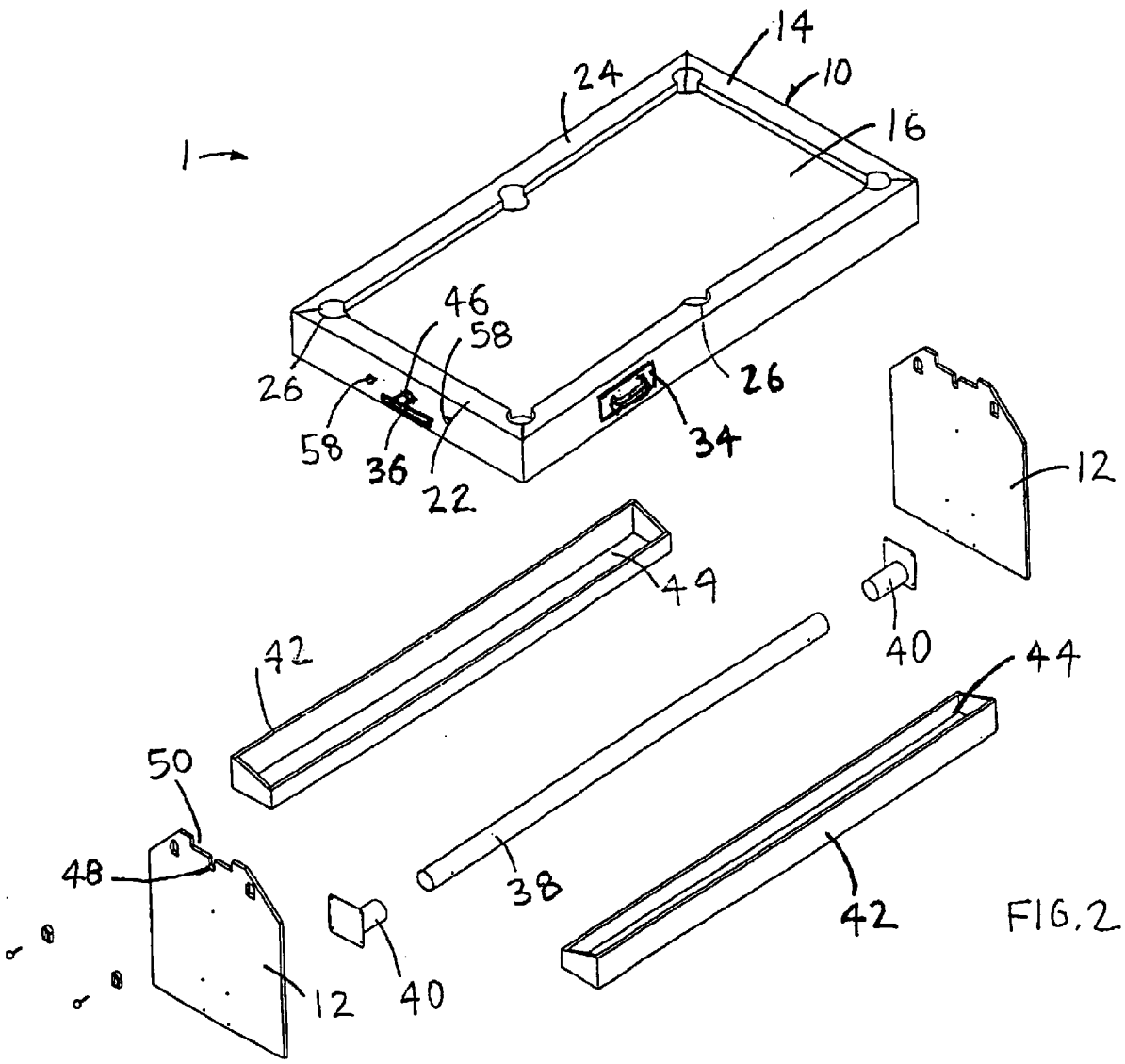
FIG. 2 is a partially exploded perspective view of a rotary game table in accordance with the present invention.
Figure 3:
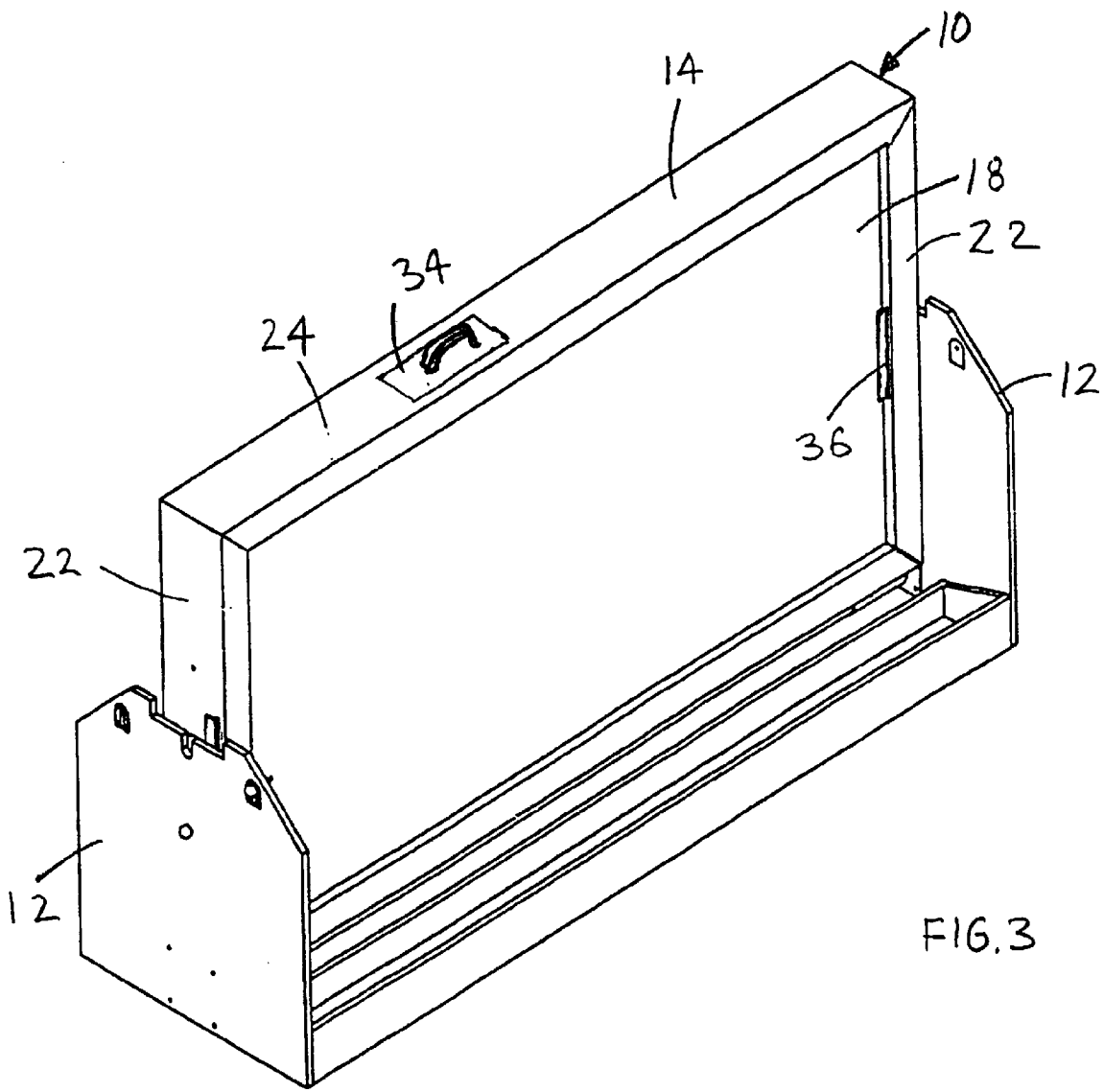
FIG. 3 is a perspective view of a rotary game table with a combination game table in a vertical orientation in accordance with the present invention.
Figure 4:
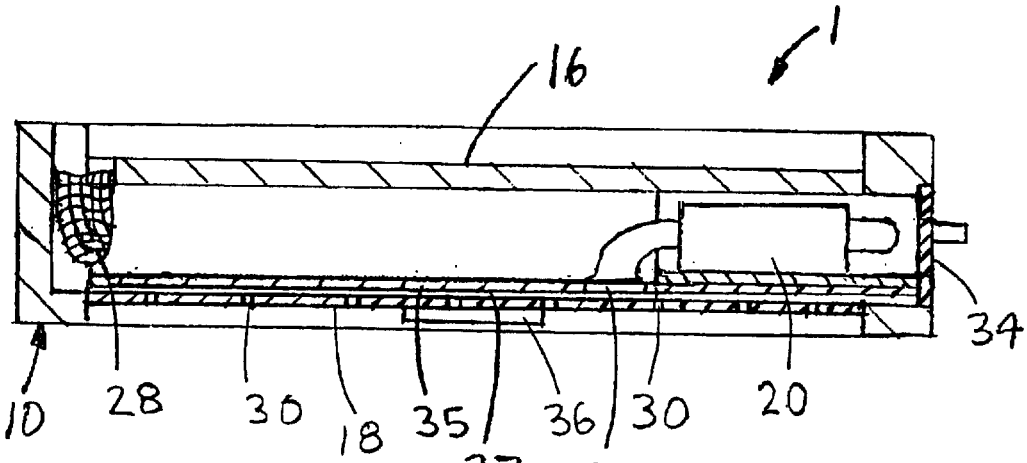
FIG. 4 is a cross sectional view of a combination game table of a rotary game table in accordance with the present invention.

With reference now to the drawings, and particularly to FIG. 1, there is shown a perspective view of a rotary game table 1. With reference to FIGS. 2–4, the rotary game table 1 includes a combination game table 10, two side support members 12 and at least one cross member. The combination game table 10 includes a game frame 14, a pool table surface 16, an air powered hockey surface 18 and an air blower 20. The pool table surface 16 is formed on one side of the combination game table 10 and an air powered hockey table surface 18 formed on the opposite side. The size of the pool table surface 16 has the same dimensions as a regulation pool table. The game frame 14 preferably includes two end frame members 22 and two lengthwise frame members 24. The two end frame members 22 are attached to the two lengthwise frame members 24 with any acceptable fastening process, such as glue or fasteners.

A perimeter of the pool table surface 16 is preferably attached to an inside perimeter of the game frame 14 with threaded fasteners, but other attachment methods may also be used. The air powered hockey surface 18 is preferably attached to an inside perimeter of the game frame 14 with glue, but other attachment methods may also be used. Pool ball pockets 26 are formed in the end frame members 22, the lengthwise frame members 24 and the pool table surface 16. The pool ball pockets 26 are formed substantially through a height of the end and lengthwise frame members. Preferably, a net 28 is attached to a wall of each pool ball pocket 26 to capture a billiard ball that falls therein.

The air powered hockey table surface 18 includes a plurality of air holes 30 formed therethrough. A diffuser plate 35 is disposed below the air powered hockey table surface 18 such that an air gap 37 is maintained therebetween. The air blower 20 is preferably retained in a sliding drawer 34 between the pool and air powered hockey table surfaces. An air hole 39 is formed through the diffuser plate 35 to receive an output of the air blower 20. The air blower 20 draws air from inside the combination game table 10. The air output from the air blower 20 flows through the air hole 39 into the air gap 37 created by the diffuser plate 35 and through the plurality of air holes 30 in the air powered hockey table surface 18. The drawer 34 is required to allow the air blower 20 to be removed from the combination game table 10 for replacement. A puck slot 36 is formed through each end frame member 22 to enable scoring in a game of air powered hockey.

At least one cross member 38 is preferably terminated by an end cap 40 on each end thereof. The end cap 40 is attached to an end of the at least one cross member 38 and to one of the two side support members 12 with any suitable fastening method. Preferably, an end of at least one accessory retainer 42 is attached to one of the side support members 12 with any suitable fastening method. Bach accessory retainer 42 includes an accessory trough 44. The accessory trough is configured to retain a plurality of game accessories such as a plurality of billiard balls, cue sticks, a rack, a puck, and two hockey paddles. A pivot pin 46 extends from each end of the combination game table 10. A pivot slot 48 is preferably formed in a top of each side support member 12 to pivotally receive the pivot pin 46. A puck clearance slot SO is also formed in a top of each side support member 12.

Figure 6:
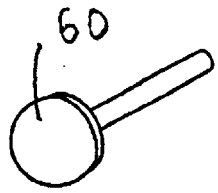
FIG. 6 is an enlarged perspective view of a locking pin of a rotary game table in accordance with the present invention.
Figure 5:
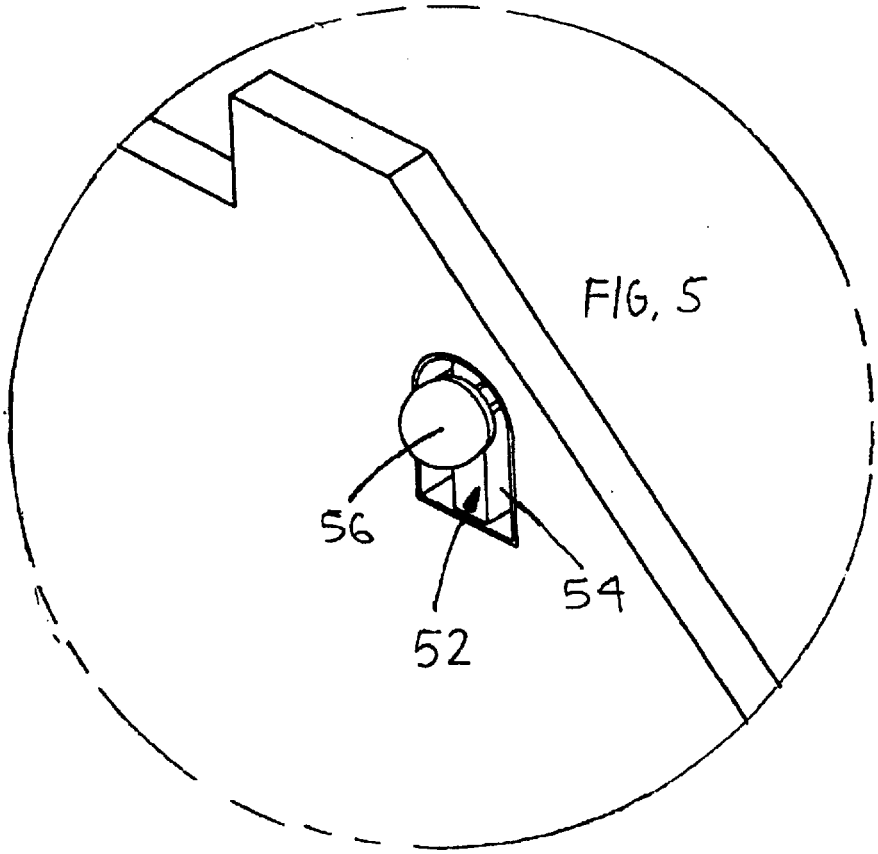
FIG. 5 is an enlarged perspective view of a locking pin device of a rotary game table in accordance with the present invention.
Figure 8:
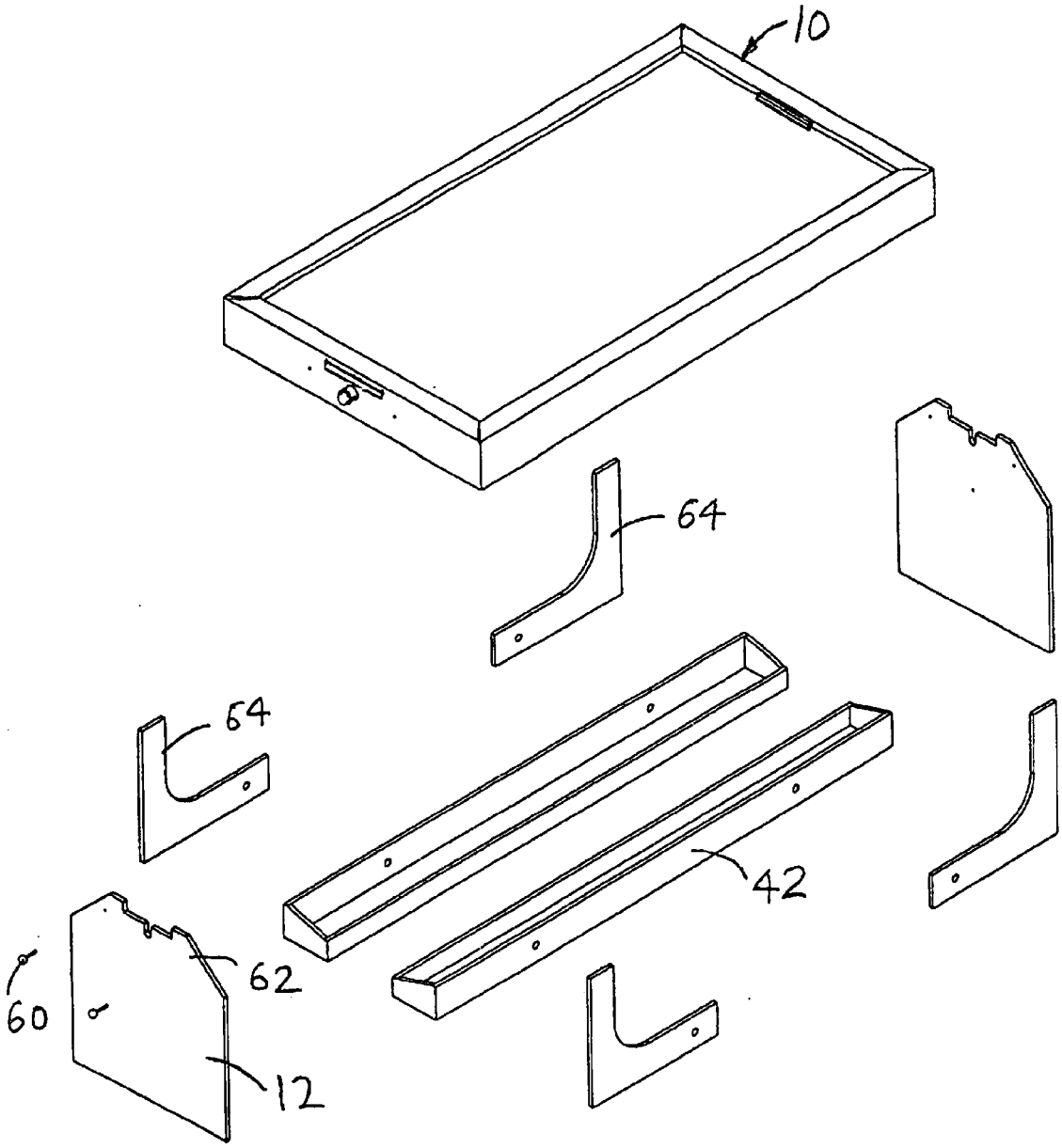
FIG. 8 is a partially exploded perspective view of a second embodiment of a rotary game table in accordance with the present invention.

With reference to FIG. 5, at least one locking pin device 52 is disposed in at least one of the two side support members 12. The locking pin device 52 includes a locking body 54 and a spring pin 56. The spring pin 56 is retained in the locking body 54. The spring pin 56 is spring loaded inside the locking body 54; such that the spring pin 56 is biased in an extended position. At least one pin cavity 58 is formed in at least one end of the combination game table 10 to receive at least one spring pin 56. The at least one spring pin 56 is withdrawn from the at least one pin cavity 58 to allow the game table to be rotated for storage or to change the game surface. Spring loaded locking pins are well known in the art and need not be explained in detail. With reference to FIG. 6, the locking pin device 52 may be replaced with a separate locking pin 60. With reference to FIG. 8, a pin hole 62 is formed through the side support member 12 instead of attaching the locking pin device 52. The locking pin 60 is withdrawn from each side support member 12 to allow rotation of the combination game table 10.

Figure 7:
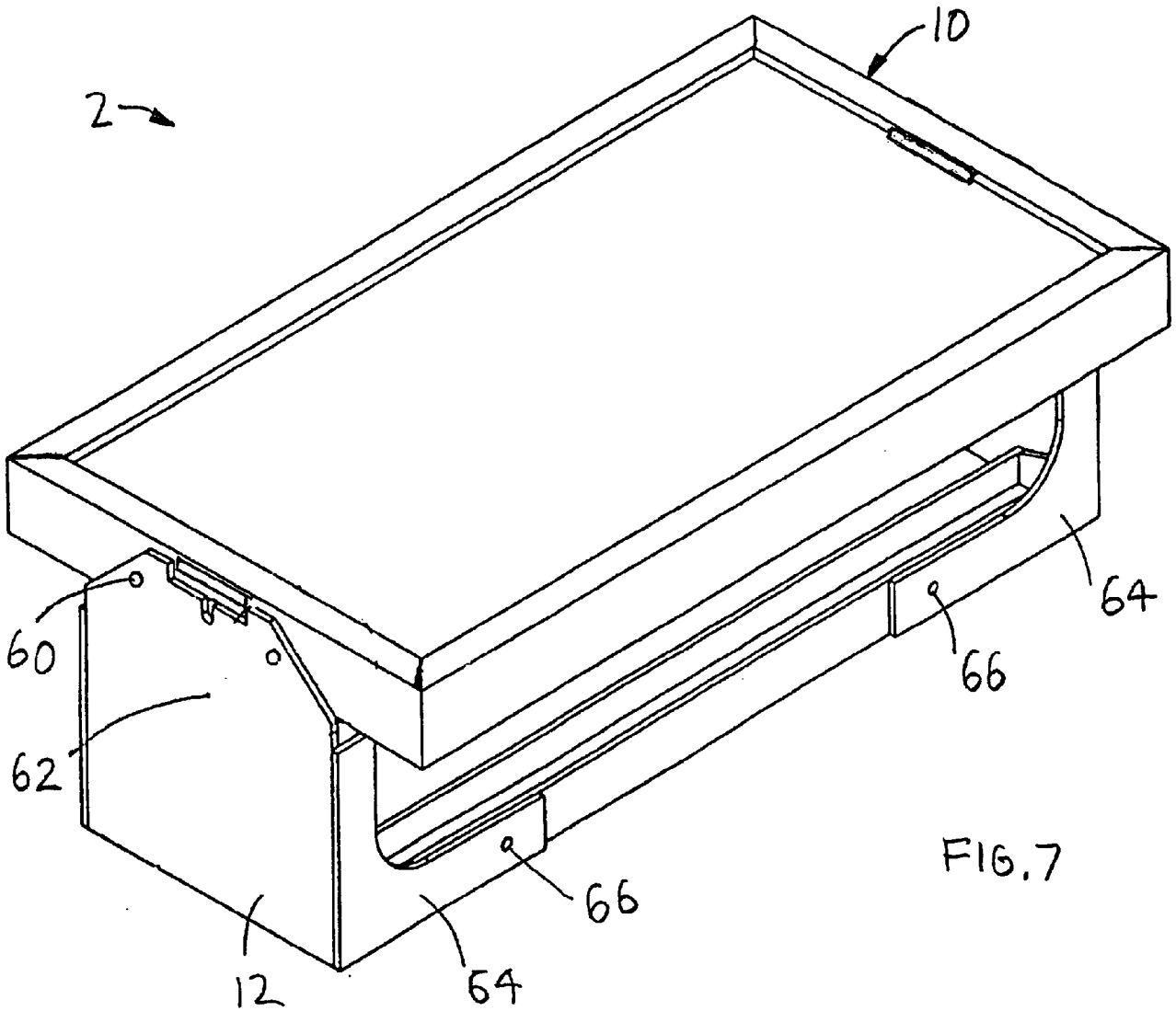
FIG. 7 is a perspective view of a second embodiment of a rotary game table in accordance with the present invention.
Figure 9:
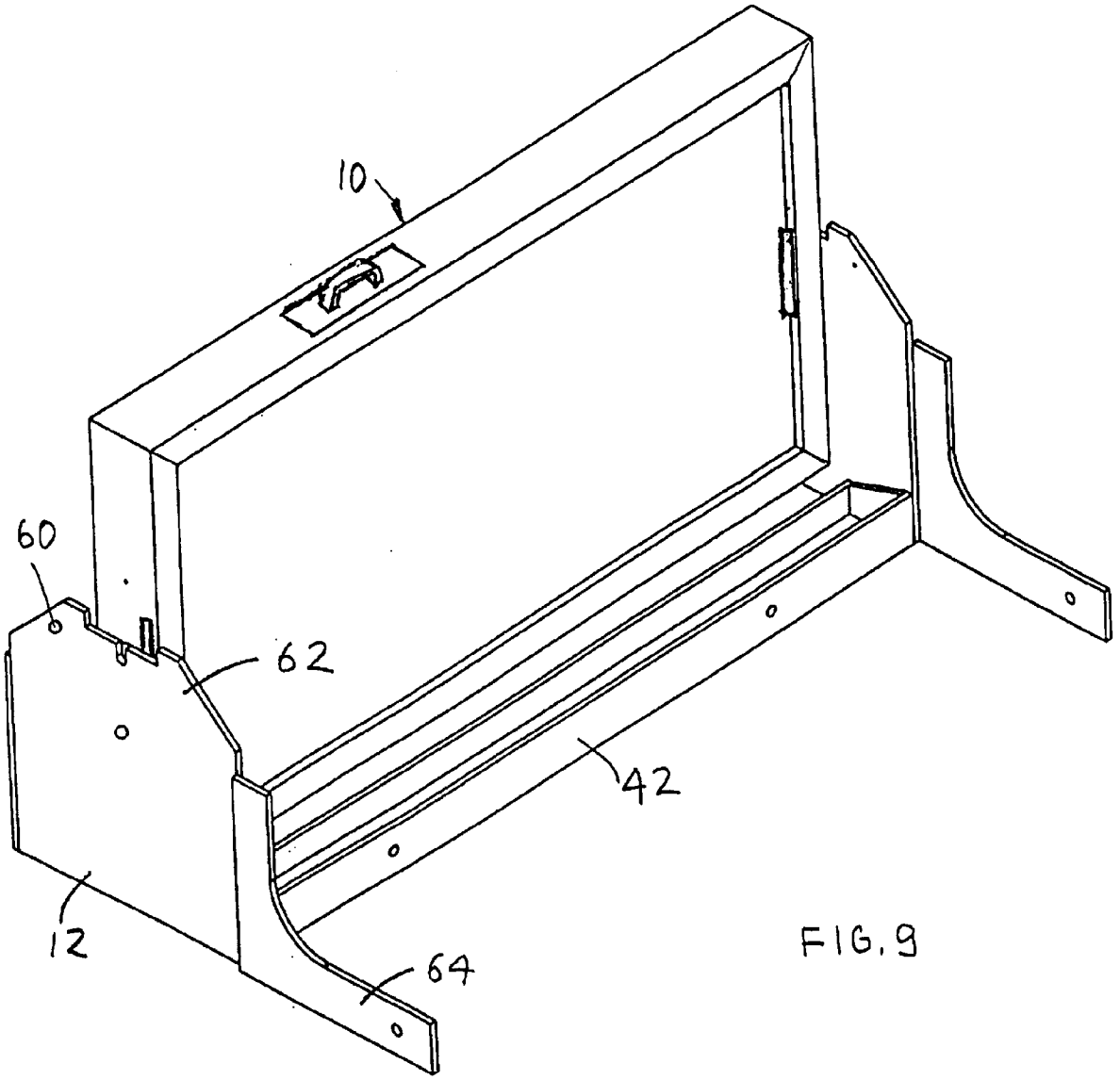
FIG. 9 is a perspective view of a second embodiment of a rotary game table with a game table in a vertical orientation in accordance with the present invention.

With reference to FIGS. 7–9, a second embodiment of a rotary game table 2 includes a combination game table 10, two side support members 12, at least two pivotal support arms 64 and at least one cross member. The combination game table 10 is the same as that of the rotary game table 1. Preferably, at least one accessory retainer 42 acts as the at least one cross member. One of the two side support members 12 is attached to each end of the at least one accessory retainer 42 with any suitable fastening process. The combination game table 10 is pivotally retained by the side support member 12 on each end thereof. Each pivotal support arm 64 is pivotally attached to one end of the side support member 12 with at least one hinge or any other suitable pivotal retention device.

To rotate the combination game table 10, the pivotal support arms 64 are swung outward such that they are parallel with the side support members 12. The pivotal support arms 64 are swung inward to retain the combination game table 10 in a horizontal position. Each pivotal support arm 64 is attachable to a single accessory retainer 42 with any suitable quick release fastener 66. Quick release fasteners are well known in the art and need not be explained in detail. Use of the at least two pivotal support arms 64 eliminates the need for the use of locking pin devices 52 or locking pins 60. However, the locking pin devices 52 or locking pins 60 may also be used in conjunction with the four pivotal support arms 64.

Figure 10:
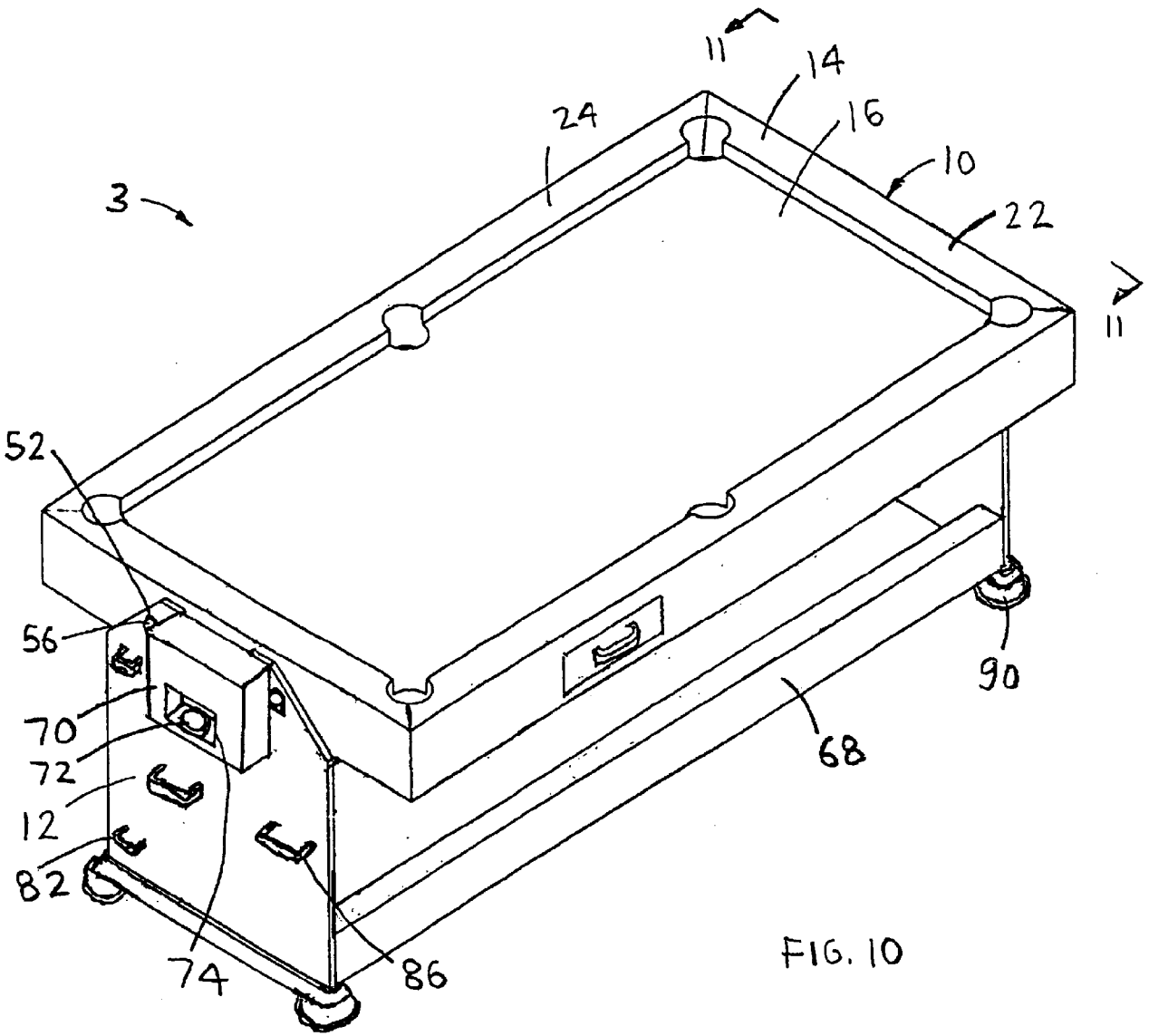
FIG. 10 is a perspective view of a third embodiment of a rotary game table with a game table in accordance with the present invention.
Figure 11:
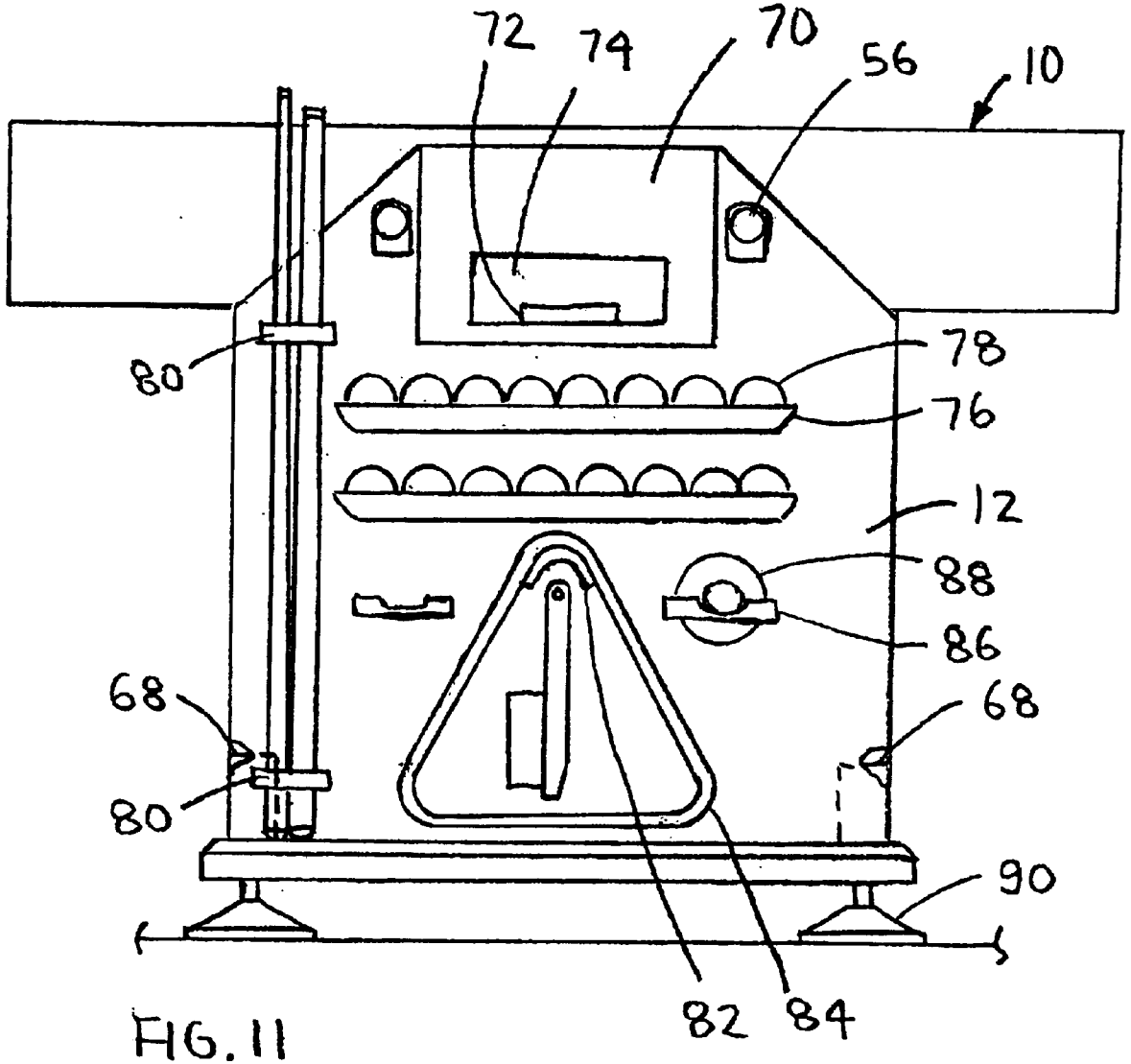
FIG. 11 is a front view of a side support member not shown in FIG. 10 of a third embodiment of a rotary game table in accordance with the present invention.

With reference to FIGS. 10–11, a third embodiment of a rotary game table 3 includes a combination game table 10, two side support members 12 and at least one cross member 68. The combination game table 10 is the same as that of the rotary game table 1. One of the two side support members 12 is attached to: each end of the at least one cross member 68 with any suitable; fastening process. The combination game table 10 is pivotally retained by the side support member 12 on each end thereof.

A hockey puck housing 70 is preferably attached to the support member,12. When a player is successful in scoring, a hockey puck 72 will fall into a puck tray 74 in the hockey puck housing 70. At least one ball tray 76 is preferably mounted to one of the two. side support members 12 to retain a plurality of billiard balls 78. At least two pool cue racks 80 are preferably attached to at least, one side support member 12. A rack holder 82 is preferably., attached to one of the two side support members 12 to retain a rack 84. At least one paddle holder 86 preferably retains a single paddle 88. To rotate the combination game table 10, at least one spring pin 56 of the at least one locking pin device 52 is withdrawn from the at least one pin cavity 58 to allow the game table to be rotated for storage or to change the game surface.

At least one locking pin 60 may be substituted for the at least one locking pin device 52. Further, the at least two pivotal, support arms 64 of the second embodiment may also be substituted for the at least one locking pin device 52. Each pivotal support arm 64 would be pivotally attached to a single side support member 12 with at least one hinge or any other suitable pivotal retention device. Each pivotal support arm 64 would be attached to a single cross member 68 with any suitable quick release fastener 66. Quick release fasteners are well known in the art and need not be explained in detail. Four height adjustable feet 90 are preferably used to level the rotary game table 3. The four height adjustable feet 90 may also used on the rotary game table 1, 2.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A rotary game table comprising:

a combination game table including a pool table disposed on one side and an air powered hockey table disposed on the other side thereof;

two side support members, at least one cross member being terminated by one of said two side support members on each end thereof, said combination game table being pivotally supported on each end by one of said two side support members; and at least two pivotal support arms, one of said two pivotal support arms being pivotally attached to an end of one of said two side support members, said at least two pivotal support arms being swung outward to allow said combination game table to be rotated, said at least two pivotal support arms being attachable to one of said at least one cross member to retain said combination game table in a horizontal orientation.

2. The rotary game table of claim 1, further comprising:

said at least one cross member being at least one accessory retainer.

3. The rotary game table of claim 1, further comprising:

an air blower being retained in a drawer, said drawer being slidably retained in said combination game table.

4. The rotary game table of claim 1, further comprising:

at least one of said two side support members being configured to retain a plurality of game accessories.

5. A rotary game table comprising:

a combination game table including a pool table disposed on one side and an air powered hockey table disposed on the other side thereof;

two side support members, at least one cross member being terminated by one of said two side support members on each end thereof, said combination game table being pivotally supported on each end by one of said two side support members;

an air blower being retained in a drawer, said drawer being slidably retained in said combination game table; and at least two pivotal support arms, one of said two pivotal support arms being pivotally attached to an end of one of said two side support members, said at least two pivotal support arms being swung outward to allow said combination game table to be rotated, said at least two pivotal support arms being attachable to one of said at least one cross member to retain said combination game table in a horizontal orientation.

6. The rotary game table of claim 5, further comprising:

said at least one cross member being at least one accessory retainer.

7. The rotary game table of claim 5, further comprising:

at least one of said two side support members being configured to retain a plurality of game accessories.

8. A rotary game table comprising:

a combination game table including a pool table disposed on one side and an air powered hockey table disposed on the other side thereof;

two side support members, at least one cross member being terminated by one of said two side support members on each end thereof, said combination game table being pivotally supported on each end by one of said two side support members, said at least one cross member being at least one accessory retainer; and at least two pivotal support arms, one of said two pivotal support arms being pivotally attached to an end of one of said two side support members, said at least two pivotal support arms being swung outward to allow said combination game table to be rotated, said at least two pivotal support arms being attachable to one of said at least one cross member to retain said combination game table in a horizontal orientation.

9. The rotary game table of claim 8, further comprising:

an air blower being retained in a drawer, said drawer being slidably retained in said combination game table.

10. The rotary game table of claim 8, further comprising:

at least one of said two side support members being configured to retain a plurality of game accessories.

* * * * *